US009732999B2

(12) United States Patent
Lundberg et al.

(10) Patent No.: US 9,732,999 B2
(45) Date of Patent: Aug. 15, 2017

(54) SYSTEM AND METHOD FOR RECOVERING REFRIGERANT

(71) Applicants: Bosch Automotive Service Solutions LLC, Warren, MI (US); Robert Bosch GmbH, Stuttgart (DE)

(72) Inventors: Dylan M. Lundberg, Lonsdale, MN (US); Mark W. McMasters, Owatonna, MN (US); William C. Brown, Owatonna, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 581 days.

(21) Appl. No.: 14/221,780

(22) Filed: Mar. 21, 2014

(65) Prior Publication Data

US 2015/0267950 A1 Sep. 24, 2015

(51) Int. Cl.
*F25B 43/02* (2006.01)
*F25B 43/04* (2006.01)
(Continued)

(52) U.S. Cl.
CPC ..... *F25B 43/02* (2013.01); *F25B 43/043* (2013.01); *F25B 45/00* (2013.01); *F25B 31/004* (2013.01);
(Continued)

(58) Field of Classification Search
CPC ..... F25B 45/00; F25B 31/004; F25B 43/02; F25B 43/006; F25B 2345/001; F25B 2345/002; F25B 2345/003
See application file for complete search history.

(56) References Cited

U.S. PATENT DOCUMENTS

2009/0158756 A1* 6/2009 Brown ..... B60H 1/00585 62/77
2009/0241560 A1 10/2009 Murray et al.
(Continued)

FOREIGN PATENT DOCUMENTS

EP 2439471 A2 4/2012
EP 2525205 A1 11/2012

OTHER PUBLICATIONS

European Search Report and Written Opinion corresponding to European Application No. 15159457.9, mailed Aug. 28, 2015 (7 pages).

*Primary Examiner* — David Teitelbaum
(74) *Attorney, Agent, or Firm* — Maginot Moore & Beck LLP

(57) ABSTRACT

A refrigerant recovery system includes a first oil separator including a chamber configured to receive refrigerant from an air conditioning system, a heat exchanger disposed within the first oil separator, and a compressor fluidly connected to the chamber and the heat exchanger. A first valve is disposed in a first flow line that is fluidly connected between an inlet of the first oil separator and a source of refrigerant and a second valve is disposed in a second flow line that fluidly connects the compressor and the heat exchanger. A controller is configured to open the first valve to enable refrigerant to pass into the chamber of the first oil separator, open the second valve so that a flow loop for refrigerant is formed between the heat exchanger and the compressor, activate the compressor to heat the refrigerant flowing through the flow loop, and subsequently commence a refrigerant recovery operation.

9 Claims, 8 Drawing Sheets

(51) Int. Cl.
*F25B 45/00* (2006.01)
*F25B 31/00* (2006.01)

(52) U.S. Cl.
CPC ... *F25B 2345/001* (2013.01); *F25B 2345/002* (2013.01); *F25B 2345/003* (2013.01); *F25B 2345/005* (2013.01); *F25B 2345/006* (2013.01); *F25B 2400/05* (2013.01)

(56) References Cited

U.S. PATENT DOCUMENTS

| | | | | |
|---|---|---|---|---|
| 2009/0272131 | A1 | 11/2009 | McMasters | |
| 2010/0196170 | A1* | 8/2010 | Chen | F04B 39/0207 417/228 |
| 2012/0090336 | A1 | 4/2012 | Brown et al. | |
| 2012/0291457 | A1* | 11/2012 | Brown | F25B 45/00 62/77 |
| 2013/0008192 | A1 | 1/2013 | McMasters et al. | |
| 2013/0032220 | A1 | 2/2013 | Cording | |
| 2013/0125567 | A1* | 5/2013 | Baltus | B01D 53/265 62/93 |
| 2013/0298578 | A1 | 11/2013 | McMasters et al. | |

* cited by examiner

SYSTEM AND METHOD FOR RECOVERING REFRIGERANT

TECHNICAL FIELD

This disclosure relates generally to refrigeration systems, and more particularly to refrigerant recovery systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein may be periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include hoses coupled to the refrigeration circuit to be serviced. A vacuum pump and compressor operate to recover refrigerant from the vehicle's air conditioning unit, flush the refrigerant, and subsequently recharge the system from a supply of either recovered refrigerant and/or new refrigerant from a refrigerant tank.

Refrigerant vapor entering the ACS unit first passes through a system oil separator or accumulator to remove oil entrained in the refrigerant from the air conditioning system. Next, the refrigerant passes through a filter and dryer unit to remove contaminants and moisture from the recovered refrigerant and the refrigerant is then pressurized by a compressor.

Refrigerant vapor is very hot as it exits the compressor during an AC recovery cycle. In a typical flow path, this hot refrigerant enters a compressor oil separator, which separates any compressor oil entrained in the refrigerant from the compressor pass-through from the refrigerant vapor. The compressor oil is returned to the compressor, while the refrigerant vapor continues along the flow path into a heat exchanger located within the system oil separator or accumulator found earlier in the path. In some refrigerant systems, the compressor oil separator is located within the system oil separator to function as the heat exchanger for the system. The refrigerant is then typically stored in a refrigerant storage tank, also referred to herein as an internal storage vessel ("ISV").

As refrigerant enters the system oil separator, heat from the heat exchanger boils the refrigerant to a vapor, while the oil entrained in the vapor remains in liquid form, separating from the vaporized refrigerant. The refrigerant vapor continues through the recovery process, while the oil settles to the bottom of the system oil separator and is collected for disposal or reuse.

However, when a recovery operation is first initiated in a current ACS unit, all components in the ACS unit are typically at ambient temperature. Therefore, when the recovery operation is first initiated, the heat exchanger is at essentially the same temperature as the refrigerant entering the system oil separator. As a result, no heat is transferred to the refrigerant, and the refrigerant does not vaporize. If the heat exchanger does not reach an adequate temperature to vaporize the refrigerant, the oil is not separated from the refrigerant and remains in the refrigerant. Additionally, a large portion of the oil in the air conditioning system travels at the beginning of the recovery operation, when the velocity of the refrigerant entering the ACS unit is high. As a result, a significant amount of system oil can be passed through the system oil separator.

The dirty, used oil is then stored with the refrigerant in the ISV, and will eventually be charged back to a vehicle in a subsequent recharging process. Recharging refrigerant contaminated with oil into the vehicle reduces air conditioning system performance, and in some instances can result in an electrical short within a compressor of the air conditioning system. What is needed, therefore, is a refrigerant recovery unit that better removes system oil during a recovery operation.

SUMMARY

In one embodiment a refrigerant recovery system is configured to preheat the heat exchanger to so that the heat exchanger more efficiently removes oil from recovered refrigerant. The refrigerant recovery system includes a first oil separator including a chamber configured to receive refrigerant from an air conditioning system, a heat exchanger disposed within the first oil separator, and a compressor including a low pressure side fluidly connected to the chamber and a high pressure side fluidly connected to the heat exchanger. A first valve is disposed in a first flow line that is fluidly connected between an inlet of the first oil separator and a source of refrigerant and a second valve disposed in a second flow line that fluidly connects the compressor and the heat exchanger. The system further includes a controller operably connected to the compressor, the first valve, and the second valve. The controller is configured to (i) operate the first valve to open to enable refrigerant to pass into the chamber of the first oil separator, (ii) operate the second valve to open so that a flow loop for refrigerant is formed between the heat exchanger and the compressor; (iii) activate the compressor to heat the refrigerant flowing through the flow loop, and (iv) subsequently commence a refrigerant recovery operation.

In another embodiment, a method of operating a refrigerant recovery system increases the system oil efficiency of the system oil separator of the recovery system. The method includes forming a refrigerant flow loop between a heat exchanger disposed within a first oil separator and a compressor in a refrigerant recovery system, activating the compressor to heat the refrigerant passing through the loop and transfer heat to the heat exchanger, and subsequently commencing a refrigerant recovery operation.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
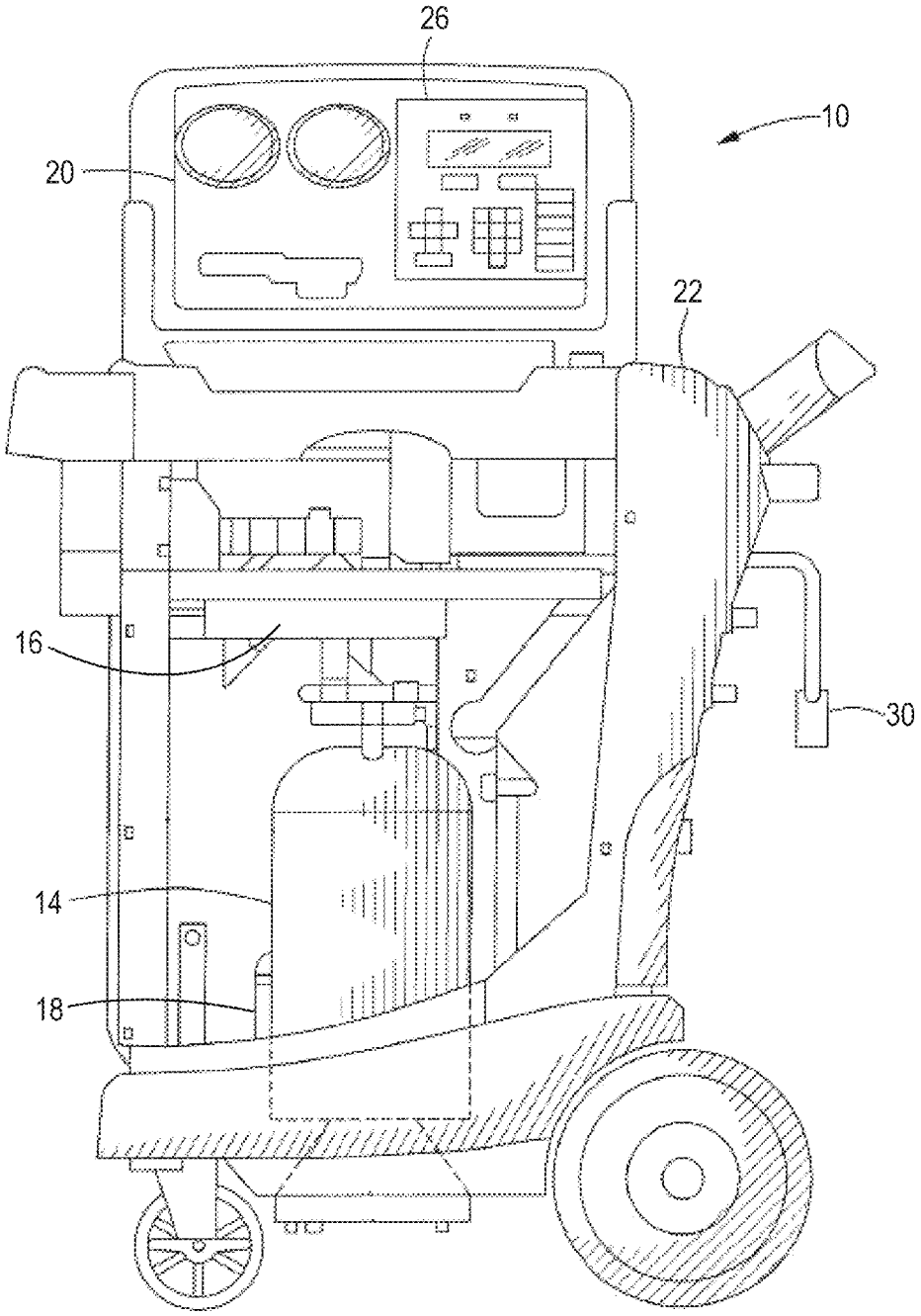
FIG. 1 PRIOR ART
FIG. 1 is a partial cutaway front view of a prior art refrigerant service system.

FIG. 1 is an illustration of a typical air conditioning service ("ACS") unit 10. The ACS unit 10 includes a refrigerant container or internal storage vessel ("ISV") 14, a manifold block 16, a compressor 18, a control module 20, and a housing 22. The exterior of the control module 20 includes an input/output unit 26 for input of control commands by a user and output of information to the user. Hose connections 30 (only one is shown in FIG. 1) protrude from the housing 22 to connect to service hoses that connect to an air conditioning ("A/C") system and facilitate transfer of refrigerant between the ACS unit 10 and the A/C system.

The ISV 14 is configured to store refrigerant for the ACS unit 10. No limitations are placed on the kind of refrigerant that may be used in the ACS unit 10. As such, the ISV 14 is configured to accommodate any refrigerant that is desired to be charged to the A/C system. In some embodiments, the ISV 14 is particularly configured to accommodate one or more refrigerants that are commonly used in the A/C systems of vehicles (e.g., cars, trucks, boats, planes, etc.), for example R-134a, $CO_2$, or R1234yf. In some embodiments, the ACS unit has multiple ISV tanks configured to store different refrigerants.

The manifold block 16 is fluidly connected to the ISV 14, the compressor 18, and the hose connections 30 through a series of valves, hoses, and tubes. The manifold block 16 includes components configured to filter and purify refrigerant recovered from a vehicle during a refrigerant recovery operation prior to the refrigerant being stored in the ISV 14.

Figure 2:
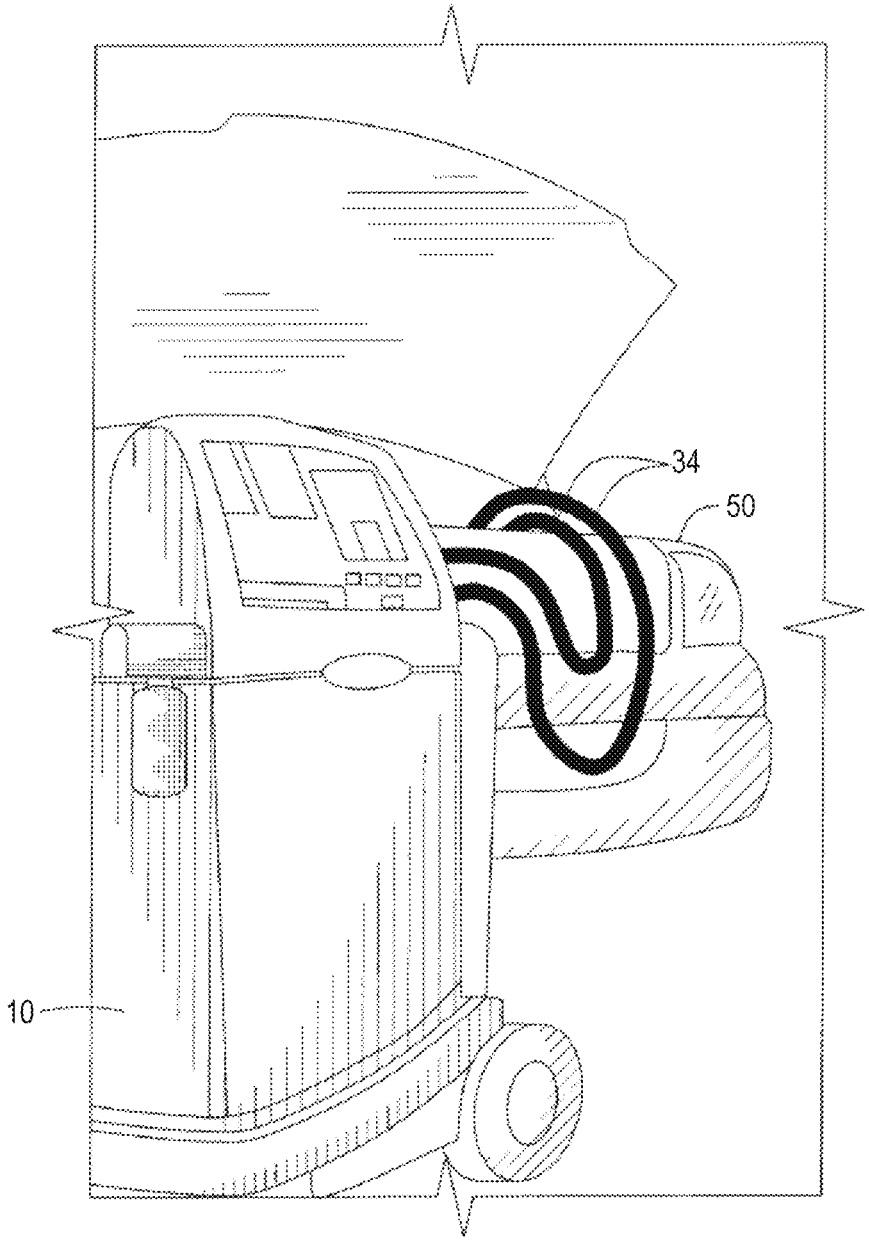
FIG. 2 PRIOR ART
FIG. 2 is side perspective view of the prior art refrigerant service system connected to a vehicle.

FIG. 2 is an illustration of a portion of the air conditioning recharging system 10 illustrated in FIG. 1 connected to a vehicle 50. One or more service hoses 34 connect an inlet and/or outlet port of the A/C system of the vehicle 50 to the hose connections 30 (shown in FIG. 1) of the ACS unit 10.

Figure 3:
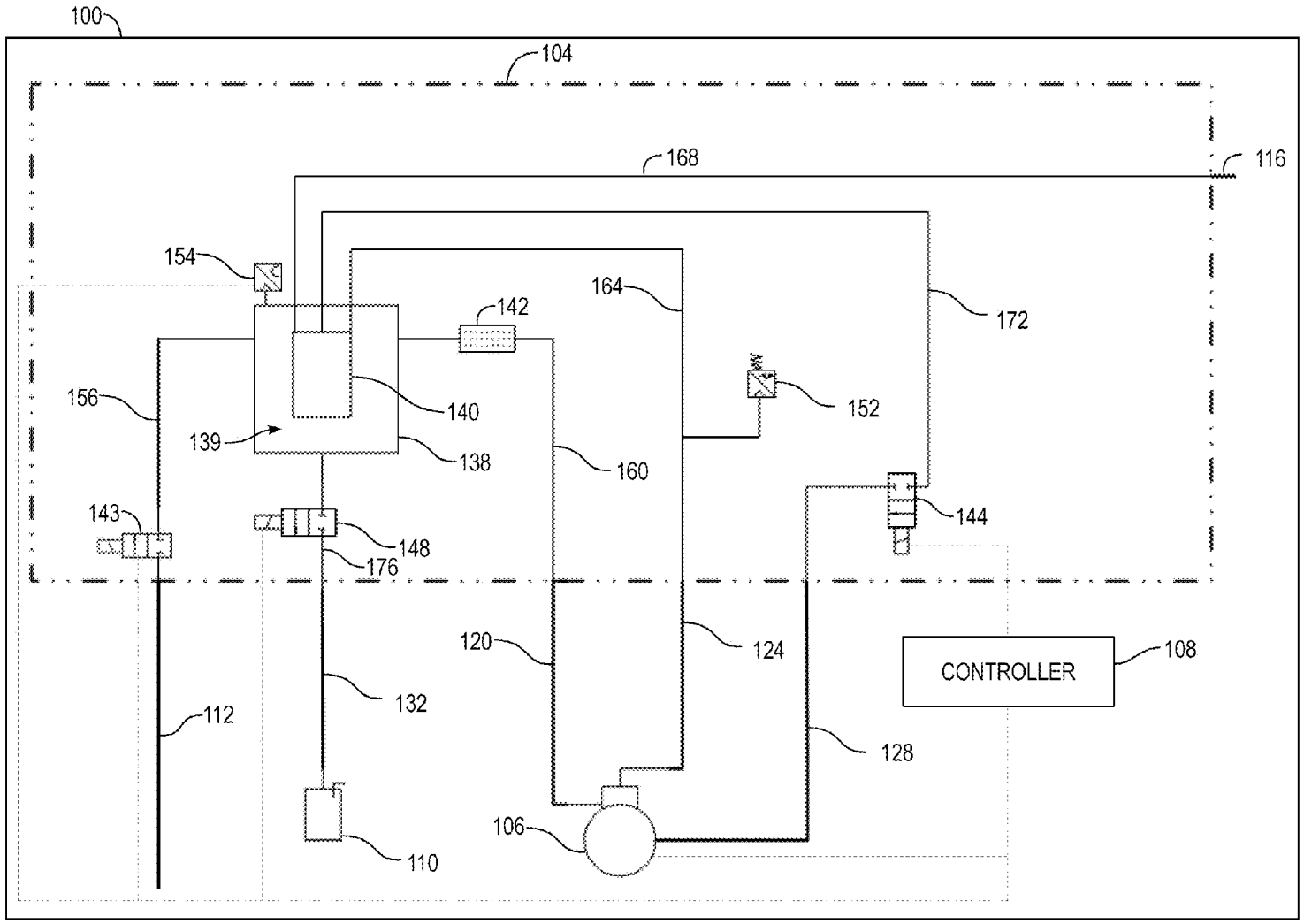
FIG. 3 is a schematic view of a refrigerant service system according to the disclosure.

FIG. 3 is a schematic diagram of a refrigerant service system 100 for servicing an air conditioning system according to one aspect of the present disclosure. The refrigerant service system 100 includes a manifold 104, a compressor 106, a controller 108, and an oil drain receptacle 110. The system 100 also includes a refrigerant input hose 112 configured to receive refrigerant, typically from a vehicle being serviced or an external storage vessel (not shown), and a refrigerant discharge hose 116 connecting the manifold 104 to a refrigerant storage tank (not shown). The system 100 further includes a compressor suction hose 120, a compressor discharge tube 124, and a compressor oil return hose 128 connecting the manifold 104 to the compressor 106. An oil drain tube 132 connects the manifold 104 to the system oil drain receptacle 110. In some embodiments, the refrigerant service system 100 is contained entirely within a portable cart, such as the one shown in FIGS. 1 and 2, to enable simple transportation and connection of the system 100 to an air conditioning system.

The manifold 104 includes an accumulator 138, also referred to as a system oil separator, having a chamber 139 in which a compressor oil separator 140 is mounted, a filter and dryer unit 142, an inlet solenoid valve 143, an oil return solenoid valve 144, an oil drain solenoid valve 148, a high pressure switch 152, and a transducer 154. The manifold 104 further includes a variety of connecting conduits bored within the manifold block to connect the various components of the manifold 104 to the hoses and tubes discussed above. The inlet solenoid valve 143 is disposed in a refrigerant input conduit 156, which connects the refrigerant input hose 112 to the accumulator 138. A compressor suction conduit 160 carries refrigerant from the accumulator 138 to the filter and dryer 142 and to the compressor suction hose 120, while a compressor discharge conduit 164 carries refrigerant from the compressor discharge tube 124 to the compressor oil separator 140. A refrigerant discharge conduit 168 fluidly connects the compressor oil separator 140 to the refrigerant discharge tube 116. A compressor oil return conduit 172 carries compressor oil from the compressor oil separator 140 to the compressor oil return hose 128, and a system oil drain 176 connects the system oil drain solenoid valve 148 to the system oil drain tube 132.

The controller 108 is operatively connected to the compressor 106, the inlet solenoid valve 143, the compressor oil return solenoid valve 144, the system oil drain solenoid valve 148, and the pressure transducer 154. The controller 108 is configured to selectively activate the solenoid valves 143, 144, 148 and the compressor 106. The pressure transducer 154 is configured to transmit a signal indicative of the pressure within the accumulator chamber 184 to the controller 108.

Operation and control of the various components and functions of the refrigerant recharge system 100 are performed with the aid of the controller 108. The controller 108 is implemented with general or specialized programmable processors that execute programmed instructions. The instructions and data required to perform the programmed functions are stored in a memory unit associated with the controller 108. The processors, memory, and interface circuitry configure the controller 108 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

During a refrigerant recovery operation, an operator connects the refrigerant service system 100 to service ports of an air conditioning system, for example a vehicle air conditioning system. The controller 108 activates a series of valves, including the inlet solenoid valve 143, between the refrigerant input hose 112 and the air conditioning system to open the path from the air conditioning system to the refrigerant input hose to remove refrigerant from the air conditioning system. The refrigerant flows through the refrigerant input hose 112 and into the refrigerant input conduit 156 in the manifold 104. The refrigerant then enters the system oil separator 138, where the heat from the compressor oil separator 140 vaporizes the refrigerant. A small amount of system oil is typically entrained in the refrigerant during normal use in the air conditioning system. The system oil has a higher boiling point than the refrigerant, and therefore remains in a liquid phase and falls to the bottom of the system oil separator 138 under the force of gravity as the refrigerant is vaporized. The system oil accumulates at the bottom of the system oil separator 138 until the system oil drain solenoid valve 148 is opened and the system oil flows through the oil drain 176 and the system oil drain tube 132 into the system oil drain receptacle 110.

The controller 108 activates the compressor 106 to generate a negative pressure in the compressor suction hose 120 and compressor suction conduit 160, generating a negative pressure to pull the vaporized refrigerant in the system oil separator 138 through the filter and dryer unit 142. The filter and dryer unit 142 removes moisture and other contaminants present in the refrigerant. The refrigerant continues through the compressor suction conduit 160 and the compressor suction hose 120 into the compressor 106. The compressor 106 pressurizes the refrigerant and forces the refrigerant through the compressor discharge tube 124 back into the compressor discharge conduit 164 in the manifold 104. The high pressure switch 152 is located in the compressor discharge conduit 164 and is configured to deactivate the compressor if the pressure downstream of the compressor 106 exceeds a threshold value to prevent excess pressure in the components downstream of the compressor 106. During the pass through the compressor 106, the temperature of the refrigerant increases substantially, such that the refrigerant in the compressor discharge conduit 164 is hotter than the refrigerant coming into the system.

The heated and pressurized refrigerant then enters the compressor oil separator 140. The hot refrigerant in the compressor oil separator 140 transfers heat to the system oil separator 138 to assist in vaporizing the refrigerant entering the system oil separator 138. In the embodiment, of FIG. 3, the compressor oil separator 140 therefore also functions as a heat exchanger within the system oil separator 138. As the refrigerant enters the compressor oil separator 140, the refrigerant boils, separating compressor oil entrained in the refrigerant during the pass through the compressor 106. The compressor oil remains in the compressor oil separator 140, while the refrigerant vapor passes into the refrigerant discharge conduit 168 and then into the refrigerant discharge hose 116, which is fluidly connected to an ISV (not shown in FIG. 3) to store the purified refrigerant.

The system 100 is also configured to periodically initiate a system oil drain process when a recovery operation is in progress. During the system oil drain process, the controller 108 deactivates the compressor 106 and activates the oil return solenoid valve 144 to open, linking the system oil separator 138 to the compressor 106 through the compressor oil return conduit 172. The compressor oil return hose 128 is connected to the compressor suction hose 120 through the compressor 106, and therefore opening the oil return solenoid valve 144 fluidly connects the system oil separator 138 to the compressor oil separator 140 through the compressor suction conduit 160, the compressor suction hose 120, the compressor 106, the compressor oil return hose 128, and the compressor oil return conduit 172. The system oil in the system oil separator 138 is forced through the system oil drain 176 and oil drain tube 132 into the system oil drain receptacle 110 for subsequent disposal or reuse.

During the refrigerant recovery operation, the system 100 periodically initiates a compressor oil return process to return compressor oil collected in the compressor oil separator 140 to the compressor 106. During the refrigerant recovery operation, the compressor 106 generates a constant suction in the compressor oil return conduit 172. To recover the compressor oil, the controller 108 operates the compressor oil return solenoid valve 144 to open, enabling flow through the compressor oil return conduit 172. The suction in the compressor oil return conduit 172 combined with the overpressure in the compressor oil separator 140 urges the compressor oil collected in the compressor oil separator 140 through the compressor oil return conduit 172 and the compressor oil return hose 128 back into the compressor 106.

In the above-described system, the system oil separator 138 removes oil from the refrigerant by vaporizing the refrigerant as the refrigerant having oil entrained therein enters the system oil separator 138. When the system begins operating, the components within the system 100 are all at approximately ambient temperature. Therefore, the heat exchanger, or compressor oil separator 140, must be heated to a temperature at which the refrigerant entering the system oil separator 138 vaporizes prior to recovering the refrigerant. The controller 108 is therefore configured to operate the system 100 to perform a preheating operation to heat the system oil separator 138. In the preheating operation, the controller 108 first operates a solenoid valve 143 to allow a predetermined amount of refrigerant into the system oil separator 138 via the input hose 112 and the input conduit 156. In one embodiment, the predetermined amount is significantly than the amount of refrigerant in the system during a refrigerant recovery operation. In one embodiment, the refrigerant for the preheating operation comes from the air conditioning system on which the recovery operation is to be performed through the inlet valve 143, while in another embodiment the refrigerant for the preheating operation comes from the ISV of the system through a charging valve (not shown in FIG. 3).

The controller 108 then activates the compressor 106 and opens the oil return valve 144. Refrigerant is drawn from the system oil separator 138 through the compressor suction conduit 160 and the compressor suction hose 120, compressed and heated in the compressor 106, and then discharged through the compressor discharge tube 124 and the compressor discharge conduit 164 into the compressor oil separator 140, which, as discussed above, acts as the heat exchanger in the chamber 139 of the system oil separator 138. Heat from the refrigerant passing through the compressor oil separator 140 increases the temperature of the compressor oil separator 140.

Figure 4:
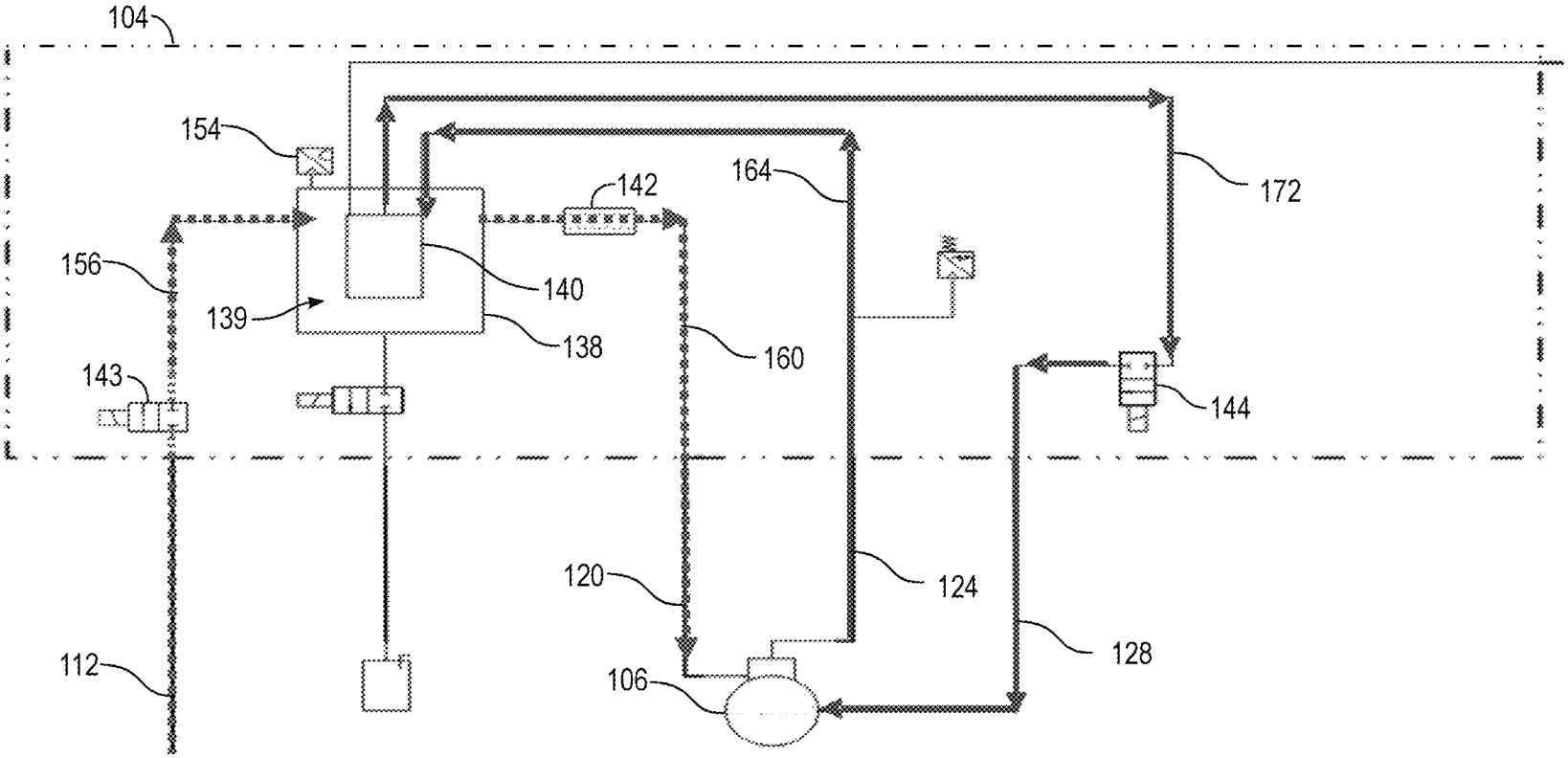
FIG. 4 is a schematic view of the refrigerant service system of FIG. 3 operating with a flow loop defined from the compressor to the compressor oil separator back to the compressor.

During normal recovery operations, the refrigerant exits the compressor oil separator 140 through the discharge conduit 168, passing through a check valve to the ISV. However, since the oil return valve 144 is open during the preheating operation, the refrigerant instead exits the compressor oil separator 140 through the oil return conduit 172, passing through the open oil return solenoid valve 144 and the compressor oil return hose 128 back into the compressor 106. A loop, illustrated in FIG. 4, is thus produced between the compressor oil separator 140 and the compressor 106. The compressor 106 continues to operate, heating the refrigerant more with each pass of the refrigerant through the compressor 106. Once the compressor oil separator 140 has reached a desired temperature, the oil return valve 144 is closed. In the embodiment in which the preheating refrigerant is transferred into the system oil separator 138 from the ISV, the refrigerant is then returned to the ISV prior to the initiation of the recovery operation. This ensures that the measured weight of the recovered refrigerant is not skewed by performing the preheating operation. In the embodiment in which the refrigerant is transferred into the system oil separator 138 from the air conditioning system, the recovery operation begins and the refrigerant used for the preheating operation is then forced to the ISV along with the remaining refrigerant being recovered.

Figure 5:
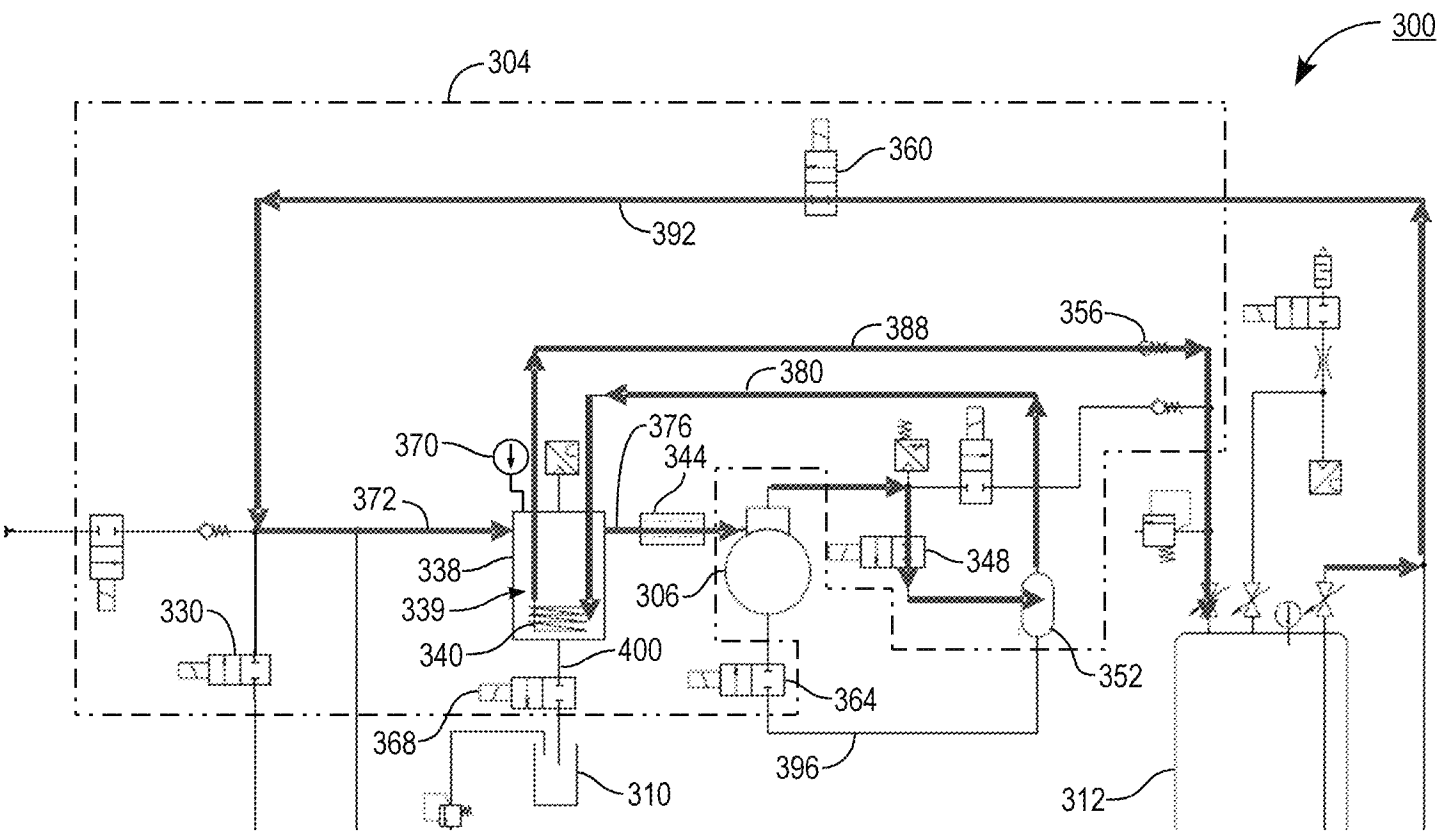
FIG. 5 is a schematic view of another refrigerant service system according to the disclosure operating with a flow loop defined from the ISV to the system oil separator to the compressor to the heat exchanger and back to the ISV.

FIG. 5 illustrates a schematic diagram of another refrigerant service system 300, also referred to as an ACS or RRR unit, for servicing an air conditioning system, such as the air conditioning system in the vehicle 50 of FIG. 2. The refrigerant service system 300 of FIG. 5 is similar to the refrigerant service system 100 of FIG. 3, with the exception that the compressor oil separator of FIG. 5 is located outside the system oil separator, and the chamber of the system oil separator includes a separate heat exchanger disposed therein.

The refrigerant service system 300 includes a manifold 304, a compressor 306, a controller 308, an oil drain receptacle 310, and an internal storage vessel, or ISV 312. The manifold 304 includes an inlet solenoid valve 330, a system oil separator 338, also referred to as an accumulator, in which a heat exchanger 340 is mounted, a filter and dryer unit 344, a compressor discharge solenoid valve 348, a compressor oil separator 352, a discharge check valve 356, a power charge solenoid 360, an oil return solenoid valve 364, and an oil drain solenoid valve 368. In some embodiments, the system oil separator 338 includes a temperature sensor 370 configured to generate a signal corresponding to the temperature in the system oil separator 338. In other embodiments, a temperature sensor is located on the heat exchanger to measure the temperature of the heat exchanger.

The manifold 304 further includes a variety of connecting conduits that may be defined the manifold block to connect the various components of the manifold 304 with the compressor 306, the oil drain receptacle 310, and the ISV 312. For simplicity of illustration, the conduits internal to the manifold 304 and the hoses and tubes extending out of the manifold 304 to make these connections are described herein as connecting lines, flow lines, or lines, though the reader should appreciate that the fluid connections between the components can be made in any suitable manner and may include any combination of pipes, hoses, tubes, and conduits.

The system 300 includes a refrigerant input line 372, in which the inlet valve 330 is disposed. The refrigerant input line 372 is configured to receive refrigerant, typically from a vehicle being serviced or an external storage vessel (not shown), and is connected to an inlet of the system oil separator 338. The outlet of the system oil separator 338 is connected to a compressor suction line 376, which fluidly connects the system oil separator 338 through the filter and dryer unit 344 into the low pressure side of the compressor 306. A compressor discharge line 380 fluidly connects the high pressure side of the compressor 306 through the compressor discharge solenoid valve 348 and the compressor oil separator 352 to the heat exchanger 340 located within the system oil separator 338. An ISV discharge line 388 fluidly connects the outlet of the heat exchanger 340 to the ISV 312 through the discharge check valve 356, which allows fluid flow only in the direction from the heat exchanger 340 to the ISV 312 and only above a predetermined pressure. The system 300 further includes a power charge line 392 connecting the ISV 312 to the input line 372, and the power charge solenoid valve 360 is located in the power charge line 392. A compressor oil return line 396 connects the compressor oil separator 352 to the compressor 306 through the oil return solenoid valve 364 to enable oil separated in the compressor oil separator 352 to be returned to the compressor 306. An oil drain line 400 connects the system oil separator 338 to the oil drain receptacle 310 through the oil drain solenoid to enable oil separated in the system oil separator 338 to be stored in the oil drain receptacle 310.

Figure 6:
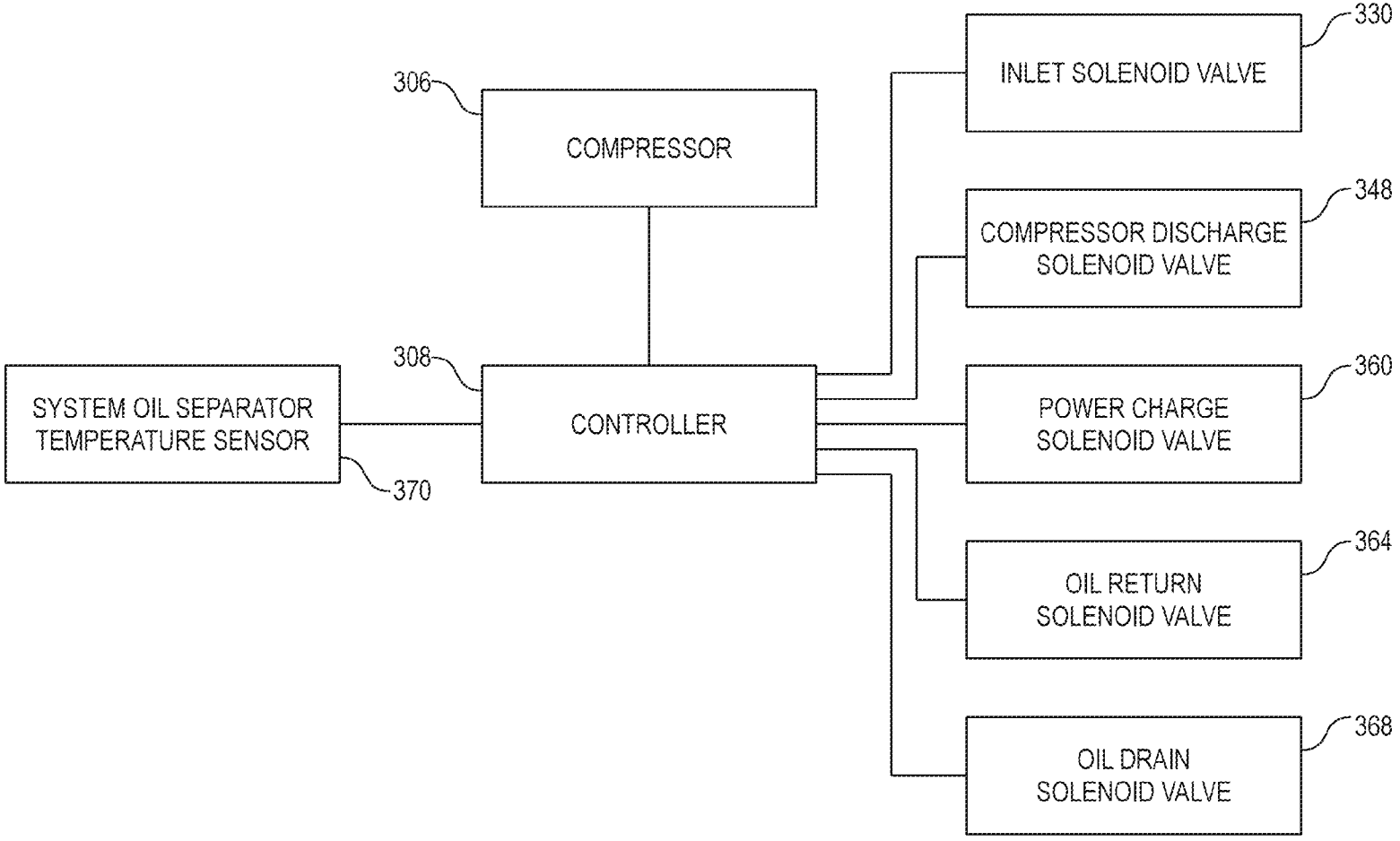
FIG. 6 is a schematic view of the control system of the refrigerant service system of FIG. 5.

As shown in FIG. 6, the controller 308 is operatively connected to the system oil separator temperature sensor 370, the compressor 306, the inlet solenoid valve 330, the compressor discharge solenoid valve 348, the power charge solenoid valve 360, the oil return solenoid valve 364, and the oil drain solenoid valve 368. The controller 308 is configured to selectively activate the solenoid valves 330, 348, 360, 364, and 368, and the compressor 106. The system oil separator temperature sensor 370 is configured to transmit a signal indicative of the temperature within the system oil separator 370 to the controller 308.

Operation and control of the various components and functions of the refrigerant recharge system 300 are performed with the aid of the controller 308. The controller 308 is implemented with general or specialized programmable processors that execute programmed instructions. The instructions and data required to perform the programmed functions are stored in a memory unit associated with the controller 308. The processors, memory, and interface circuitry configure the controller 308 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In the embodiment of FIG. 5, the system oil separator 338 is configured to receive refrigerant during a refrigerant recovery operation. Heated refrigerant exiting the compressor 306 and the compressor oil separator 352 flows through the heat exchanger 340 to transfer heat into the system oil separator 338 to vaporize the refrigerant in the system oil separator 338. The vaporized refrigerant separates from the liquid oil, which has a higher boiling point, enabling the refrigerant to be purified in the system oil separator.

As discussed above with regard to the embodiment of FIG. 3, when the system is initially started, all the components, including the heat exchanger 340, are at ambient temperature. As such, the heat exchanger 340 is at substantially the same temperature as the system oil separator, and is therefore unable to transfer heat to the system oil separator 338 to vaporize the refrigerant in the system oil separator 338. Consequently, a preheating operation is performed to heat the heat exchanger 340 to a suitable temperature prior to initiation of a refrigerant recovery operation.

The preheating operation beings with the controller 308 operating the power charge solenoid valve 360 to open to allow a predetermined amount of refrigerant to pass through the power charge line 392 to the input line 372 and into the system oil separator 338. In some embodiments the controller 308 pulses the power charge solenoid valve 360 to control the pressure or flow rate of the refrigerant in the system oil separator 338. The controller 308 then activates the compressor 306 and opens the compressor discharge solenoid valve 348, producing a flow loop from the ISV 312 to the system oil separator 338, compressor 306, heat exchanger 340, back to the ISV 312. The refrigerant in the ISV 312 has already been purified, and therefore should contain minimal amounts of entrained oil. As such, the oil separation in the system oil separator 338 is not necessary when the refrigerant from the ISV passes through the system oil separator 338. Heated refrigerant exits the compressor 306 and travels to the heat exchanger 340, increasing the temperature of the heat exchanger 340.

Once the heat exchanger 340 reaches a threshold temperature, the preheating operation terminates. In one embodiment, the preheating operation is performed for a predetermined time period before termination. In another embodiment, the compressor oil separator 338 includes the temperature sensor 370, which generates a signal indicative of the temperature in the system oil separator 338, and the controller 308 is configured to terminate the preheating operation when the temperature in the system oil separator reaches a predetermined threshold temperature. To terminate the preheating operation, the controller 308 closes power charge solenoid valve 360 and the refrigerant used for the preheating operation is returned to the ISV 312. The controller 308 then deactivates the compressor 306, and commences the refrigerant recovery operation.

The reader should appreciate that both of the above-described preheating operations can be performed on each of the refrigerant recovery systems illustrated in FIGS. 3 and 5. For example, the embodiment of FIG. 3 can be configured to produce a loop between the system oil separator and the ISV to preheat the compressor oil separator, and the embodiment of FIG. 5 can be configured to produce a closed loop between the system oil separator and the compressor in order to preheat the heat exchanger.

Figure 7:
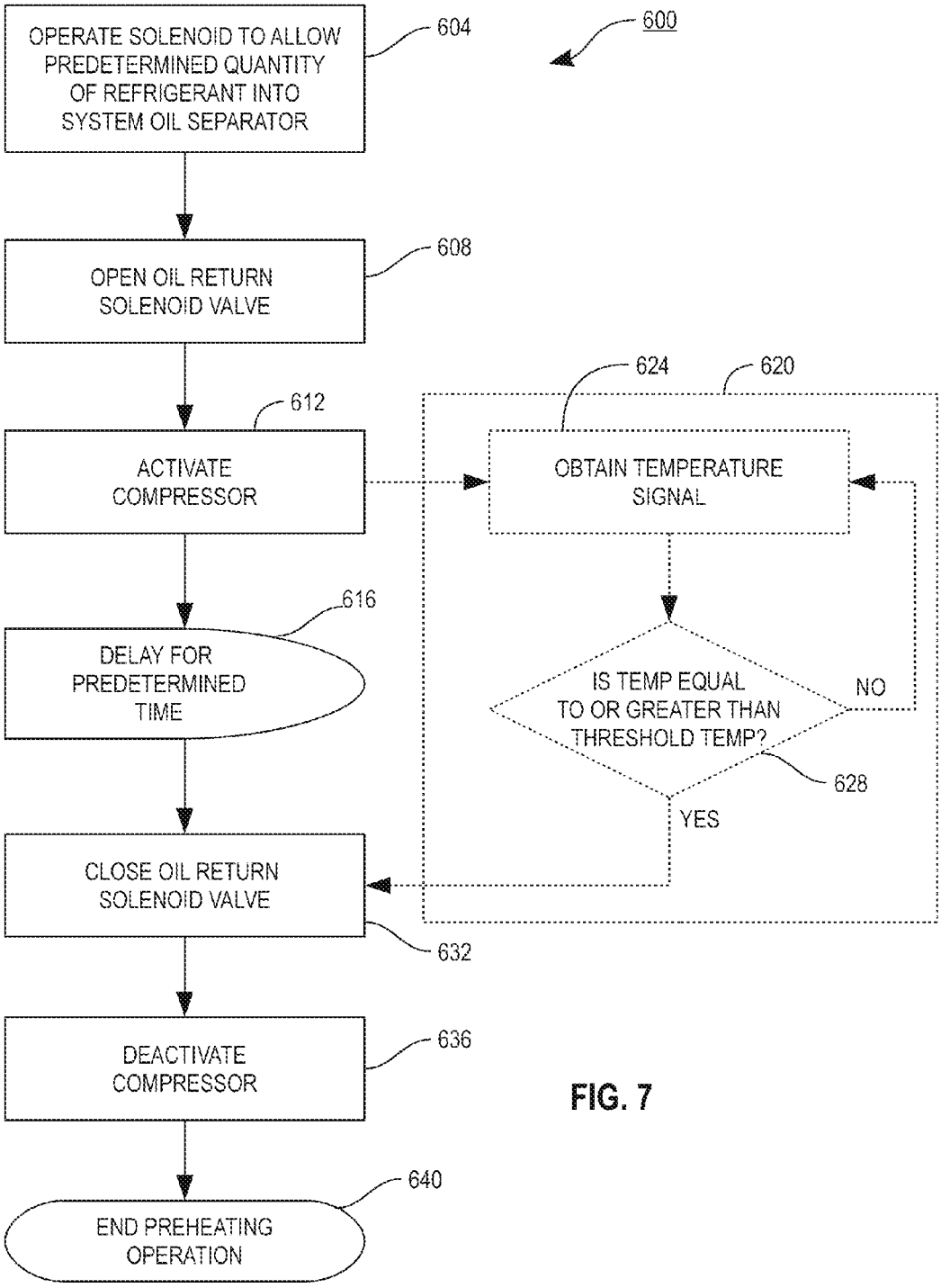
FIG. 7 is a process diagram of a method of operating a refrigerant service system to preheat a heat exchanger.

FIG. 7 illustrates a method 600 for operating a refrigerant recovery system, for example the refrigerant service systems 100 and 300 of FIGS. 3 and 5, respectively, during a heat exchanger preheating operation. The controller of the refrigerant service system includes a processor configured to execute programmed instructions stored in a memory associated with the controller to implement the method 600.

The method 600 begins with the controller operating a solenoid valve in the system to allow a predetermined quantity of refrigerant into the system oil separator (block 604). In one embodiment, the controller opens a solenoid valve separating the system oil separator from the air conditioning system being serviced, such that the refrigerant passing into the system oil separator is the refrigerant being recovered from the system. In another embodiment, the controller operates a solenoid valve, for example the power charge solenoid valve shown in FIG. 5, to open to fluidly connect the ISV to the system oil separator, passing refrigerant that has been previously stored in the ISV into the system oil separator. Once the predetermined quantity of refrigerant is allowed into the system, the solenoid valve is closed to trap the predetermined quantity of refrigerant in the system. In one embodiment, the controller monitors a signal generated by a pressure transducer located in the system oil separator until a predetermined pressure is reached in the system oil separator indicating that the predetermined quantity of refrigerant has been allowed into the system oil separator. In another embodiment, the solenoid valve is opened for a predetermined period of time to allow the predetermined quantity of refrigerant in the system oil separator.

The controller then operates to open the oil return solenoid valve (block 608), which produces a flow loop between the compressor and the heat exchanger, which, as described above, is the compressor oil separator in some embodiments. The controller activates the compressor (block 612) to pressurize and heat the refrigerant as it passes through the compressor, thereby moving heated and pressurized refrigerant from the compressor to the heat exchanger. In one embodiment, the controller is configured to delay for a predetermined period of time (block 616) while the refrigerant is circulated through the flow loop, gaining additional heat with every pass through the compressor, and transferring additional heat to the heat exchanger. The process then proceeds to block 632.

In another embodiment, the controller is configured to actively monitor the temperature in either the system oil separator or the heat exchanger (block 620) instead of delaying for a predetermined time. The controller obtains a temperature signal from a temperature sensor located in wither the system oil separator or the heat exchanger (block 624) and compares the obtained temperature signal with a predetermined threshold temperature (block 628). If the temperature signal indicates that the temperature in the system oil separator or the heat exchanger is below the predetermined threshold temperature, then the process continues at block 624 with obtaining the temperature signal again. If the temperatures signal is equal to or greater than the predetermined threshold temperature, then the process continues at block 632.

Once the predetermined delay time (block 616) has elapsed or the temperature in the system oil separator or heat exchanger is greater than the threshold temperature, the controller closes the oil return solenoid valve (block 632). The loop is therefore disconnected, and the pressure in the heat exchanger forces a check valve separating the heat exchanger from the ISV input open, moving the refrigerant into the ISV. The compressor is deactivated (block 636) and the preheating operation terminates (block 640). A refrigerant recovery operation is then initiated to recover the refrigerant from the air conditioning system connected to the refrigerant service system. In some embodiments, the controller is not configured to deactivate the compressor (block 636), instead leaving the compressor activated as the refrigerant recovery operation commences.

Figure 8:
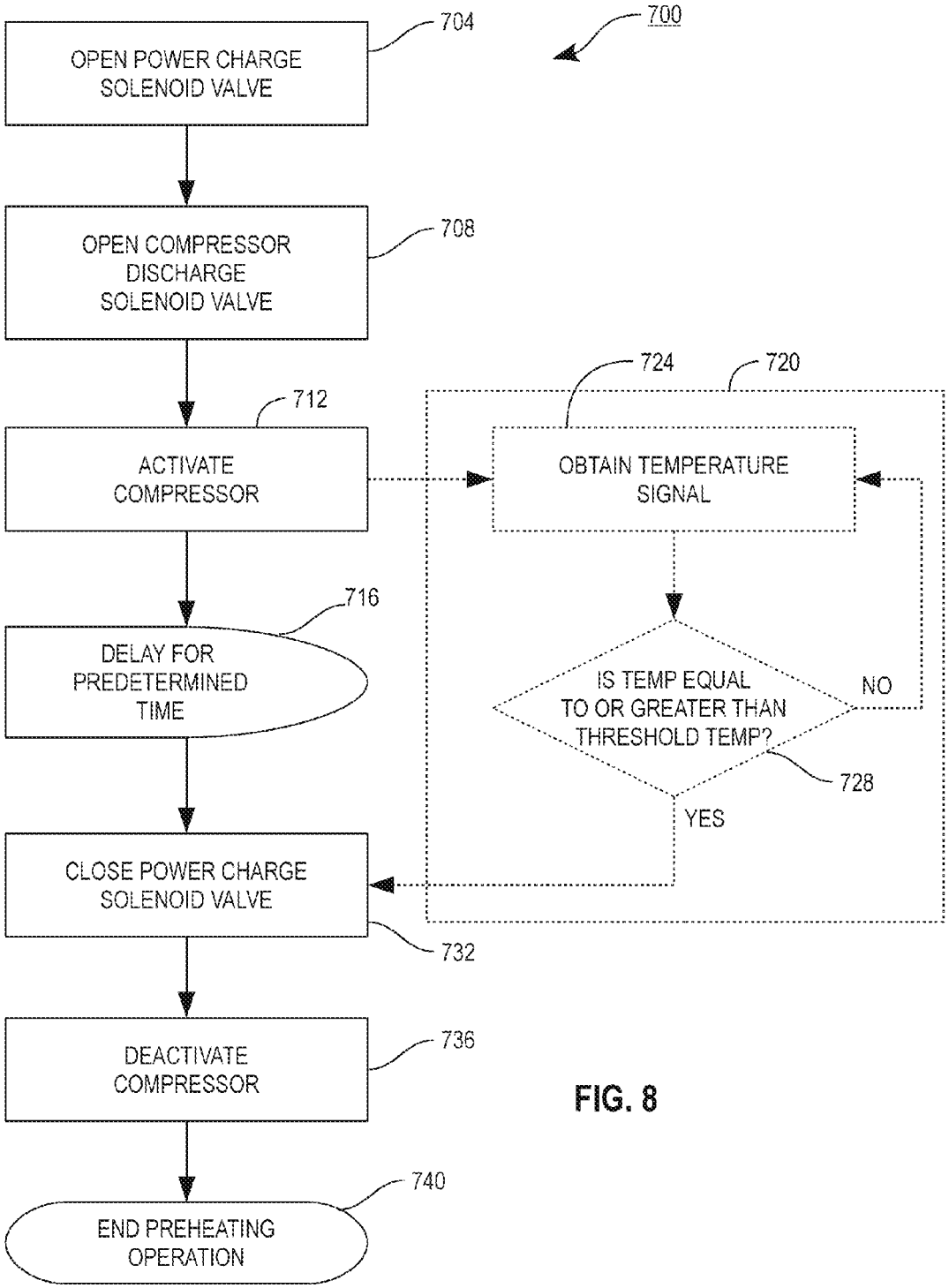
FIG. 8 is a process diagram of another method of operating a refrigerant service system to preheat a heat exchanger.

FIG. 8 illustrates another method 700 for operating a refrigerant recovery system, for example the refrigerant service systems 100 and 300 of FIGS. 3 and 5, respectively, during a heat exchanger preheating operation. The controller of the refrigerant service system is configured with a processor configured to execute programmed instructions stored in a memory associated with the controller to implement the method 700.

The method 700 begins with the controller operating the power charge solenoid valve to open (block 704), fluidly connecting the ISV to the system oil separator. In one embodiment the controller is configured to pulse the power charge solenoid valve, or open and close the valve at predetermined intervals, to control the flow rate and pressure of the refrigerant transferring from the ISV to the system oil separator. In one embodiment, the controller monitors a signal generated by a pressure transducer located in the system oil separator to determine the intervals at which the power charge solenoid valve is pulsed.

The controller then operates the compressor discharge solenoid valve to open (block 708), which produces a flow loop between the system oil separator, the compressor, the heat exchanger, which, as described above, is the compressor oil separator in some embodiments, and the ISV. The controller activates the compressor (block 712) to pressurize and heat the refrigerant as it passes through the compressor, thereby moving heated and pressurized refrigerant from the compressor to the heat exchanger. In one embodiment, the controller is configured to delay for a predetermined period of time (block 716) while the refrigerant is circulated through the flow loop, gaining additional heat with every pass through the compressor, and transferring additional heat to the heat exchanger. The process then proceeds to block 732.

In another embodiment, the controller is configured to actively monitor the temperature in either the system oil separator or the heat exchanger (block 720) instead of delaying for a predetermined time. The controller obtains a temperature signal from a temperature sensor located in wither the system oil separator or the heat exchanger (block 724) and compares the obtained temperature signal with a predetermined threshold temperature (block 728). If the temperature signal indicates that the temperature in the system oil separator or the heat exchanger is below the predetermined threshold temperature, then the process continues at block 724 with obtaining the temperature signal again. If the temperatures signal is equal to or greater than the predetermined threshold temperature, then the process continues at block 732.

Once the predetermined delay time has elapsed (block 716) or the temperature in the system oil separator or heat exchanger is greater than the threshold temperature, the controller closes the power charge solenoid valve (block 732), disconnecting the ISV from the system oil separator and breaking the loop. The compressor is then deactivated (block 736). In one embodiment, the compressor is not deactivated (block 736) until after the refrigerant in the refrigerant service system has completely been evacuated into the ISV in order to ensure that the measured quantity of refrigerant recovered from the air conditioning system is not affected by the preheating operation. The preheating operation then terminates (block 740), and a refrigerant recovery operation is then initiated to recover the refrigerant from the air conditioning system connected to the refrigerant service system. In some embodiments, the controller is not configured to deactivate the compressor (block 736), instead leaving the compressor activated as the refrigerant recovery operation commences.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. A refrigerant recovery system comprising:

a first oil separator including a chamber configured to receive refrigerant from an air conditioning system;

a heat exchanger disposed within the first oil separator;

a compressor including a low pressure side fluidly connected to the chamber and a high pressure side fluidly connected to the heat exchanger;

a first valve disposed in a first flow line that is fluidly connected between an inlet of the first oil separator and a source of refrigerant;

a second valve disposed in a second flow line that fluidly connects the compressor and the heat exchanger; and a controller operably connected to the compressor, the first valve, and the second valve and configured to (i) operate the first valve to open to enable refrigerant to pass into the chamber of the first oil separator, (ii) operate the second valve to open after the operating of the first valve to open; (iii) activate the compressor after operation of the first and second valves and while the second valve is open so as to form a closed flow loop through which the refrigerant recirculates through the heat exchanger and the compressor, the compressor heating the refrigerant flowing through the dosed flow loop, and (iv) subsequent to the activation of the compressor, commence a refrigerant recovery operation.

2. The refrigerant recovery system of claim 1 wherein the controller is further configured to operate the first valve to close after operating the first valve to open, before operating the second valve to open, and after a predetermined quantity of refrigerant has passed into the chamber of the first oil separator.

3. The refrigerant recovery system of claim 2 wherein:

the first flow line includes an inlet line configured to fluidly connect an air conditioning system to the inlet of the first oil separator; and the first valve is disposed in the inlet line.

4. The refrigerant recovery system of claim 2 further comprising:

a refrigerant storage vessel, wherein the first flow line includes a charge line fluidly connecting the refrigerant storage vessel to the first oil separator, and wherein the first valve is disposed in the charge line.

5. The refrigerant recovery system of claim 1 further comprising:

a refrigerant storage vessel, wherein the first flow line includes a charge line fluidly connecting the refrigerant storage vessel to the first oil separator, and the first valve is disposed in the charge line, and wherein, after the operation of the first valve to open and before the operation of the second valve to open, the controller is configured to operate the first valve to intermittently open and close to allow refrigerant to pass from the refrigerant storage vessel to the first oil separator at a predetermined average flow rate.

6. The refrigerant recovery system of claim 5 wherein:

the second flow line includes a compressor discharge line fluidly connecting the high-pressure side of the compressor to the heat exchanger, the second valve is disposed in the compressor discharge line, and the closed flow loop is defined from the refrigerant storage vessel through the first oil separator to the compressor, to the heat exchanger, and back to the refrigerant storage vessel.

7. The refrigerant recovery system of claim 1 further comprising:

a temperature sensor disposed in the first oil separator, wherein, after the activation of the compressor, the controller is configured to monitor a temperature signal generated by the temperature sensor to determine whether a temperature of the heat exchanger exceeds a predetermined threshold, and to subsequently commence the refrigerant recovery operation after the temperature of the heat exchanger exceeds the predetermined threshold.

8. The refrigerant recovery system of claim 7 wherein the temperature sensor is disposed in the heat exchanger.

9. The refrigerant recovery system of claim 1 wherein the controller is configured to commence the refrigerant recovery operation after elapse of a predetermined time after the activation of the compressor.

* * * * *